US007107800B2

(12) United States Patent
Chen

(10) Patent No.: US 7,107,800 B2
(45) Date of Patent: Sep. 19, 2006

(54) DOOR BOLT

(76) Inventor: Hong Yao Chen, P.O. Box 82-144, Taipei (TW)

( * ) Notice: Subject to any disclaimer, the term of this patent is extended or adjusted under 35 U.S.C. 154(b) by 0 days.

(21) Appl. No.: 10/301,690

(22) Filed: Nov. 22, 2002

(65) Prior Publication Data

US 2004/0099022 A1 May 27, 2004

(51) Int. Cl.
*E05B 65/00* (2006.01)

(52) U.S. Cl. ..... 70/93; 292/270; 292/268

(58) Field of Classification Search ..... 70/93, 70/DIG. 64, DIG. 12; 292/268–270, 277, 292/278, 272–274, 290, 292, 295–298
See application file for complete search history.

(56) References Cited

U.S. PATENT DOCUMENTS 926,321 A * 6/1909 Dominik ..... 292/263
963,427 A * 7/1910 Erkens ..... 70/93
984,612 A * 2/1911 Spangler ..... 292/269
4,048,822 A * 9/1977 Luling ..... 70/93
4,174,861 A * 11/1979 Drake ..... 292/269
4,374,599 A * 2/1983 Hurt ..... 292/270
4,436,331 A * 3/1984 Glickman et al. ..... 292/270
4,711,479 A * 12/1987 Grandinetti ..... 292/272
4,815,305 A * 3/1989 Smith ..... 70/93
4,846,514 A * 7/1989 Flynn ..... 292/268
5,669,256 A * 9/1997 Chung ..... 70/93
5,899,509 A * 5/1999 Ferguson et al. ..... 292/259 R
6,145,351 A * 11/2000 Levenson ..... 70/93

* cited by examiner

*Primary Examiner*—Suzanne Dino Barrett
(74) *Attorney, Agent, or Firm*—Leong C. Lei

(57) ABSTRACT

A door bolt is constructed to include a jam plate fixedly fastened to a doorjamb, and a doorplate assembly installed in the free end of a door panel and adapted to secure the free end of the door panel to the jamb plate, the doorplate assembly having a lock cylinder controlled by a key to move a movable frame bar in a fixed locating frame bar and to further move two locking straps relative to each other between a first position where the doorplate assembly is prohibited from escaping out of the constraint of the jamb plate and a second position where the doorplate assembly is released from the constraint of the jamb plate.

3 Claims, 5 Drawing Sheets

DOOR BOLT

BACKGROUND OF THE INVENTION

1. Field of the Invention

The present invention relates to door bolting devices and, more particularly, to a door bolt adapted to lock the door, enabling the door to be slightly opened without letting people outside the house pass to the inside of the house.

2. Description of the Related Art

Various door locking devices have been disclosed for use to lock the door, and have appeared on the market. In order to let the door be slightly opened without allowing people outside the house to pass to the inside of the house, a door bolt may be used. A conventional door bolt is known comprised of doorplate and a jamb plate. The doorplate is fixedly fastened to the free end of the door panel, having an elongated sliding slot. The jamb plate is fixedly fastened to the doorjamb, having a chain and a slide bolt at the end of the chain for coupling to the sliding slot of the doorplate. There is known another design of door bolt in which the jamb plate has a hinged retainer bar; the doorplate has a hook. When the door closed, the hinged retainer bar is turned toward the hook of the doorplate, enabling the longitudinal sliding slot of the hinged retainer bar to be coupled to the hook of the doorplate.

The aforesaid prior art door bolts are still not satisfactory in function. If the person inside the house meets with an accident and is unable to open the door, any person outside the house cannot unlock the door bolt from the outside. In this case, a person outside the house must destroy the door to get into the inside of the house.

SUMMARY OF THE INVENTION

The present invention has been accomplished under the circumstances in view. It is the main object of the present invention to provide a door bolt, which enables a person outside the house to unlock the door bolt with a key. To achieve this and other objects of the present invention, the door bolt comprises a jam plate fixedly fastened to a doorjamb, and a doorplate assembly installed in the free end of a door panel and adapted to secure the free end of the door panel to the jamb plate, for enabling the door panel to be slightly opened without letting people outside the house pass to the inside of the house. The doorplate assembly comprises a casing, a hollow locating frame bar mounted within the casing, a movable frame bar axially slidably inserted into the locating frame bar, two locking straps coupled to the movable frame bar and the locating frame bar, and a lock cylinder controlled by a key to move the movable frame bar in the locating frame bar and to further move the two locking straps relative to each other between a first position where the doorplate assembly is prohibited from escaping out of the constraint of the jamb plate and a second position where the doorplate assembly is released from the constraint of the jamb plate.

DETAILED DESCRIPTION OF THE PREFERRED EMBODIMENT

Figure 1:
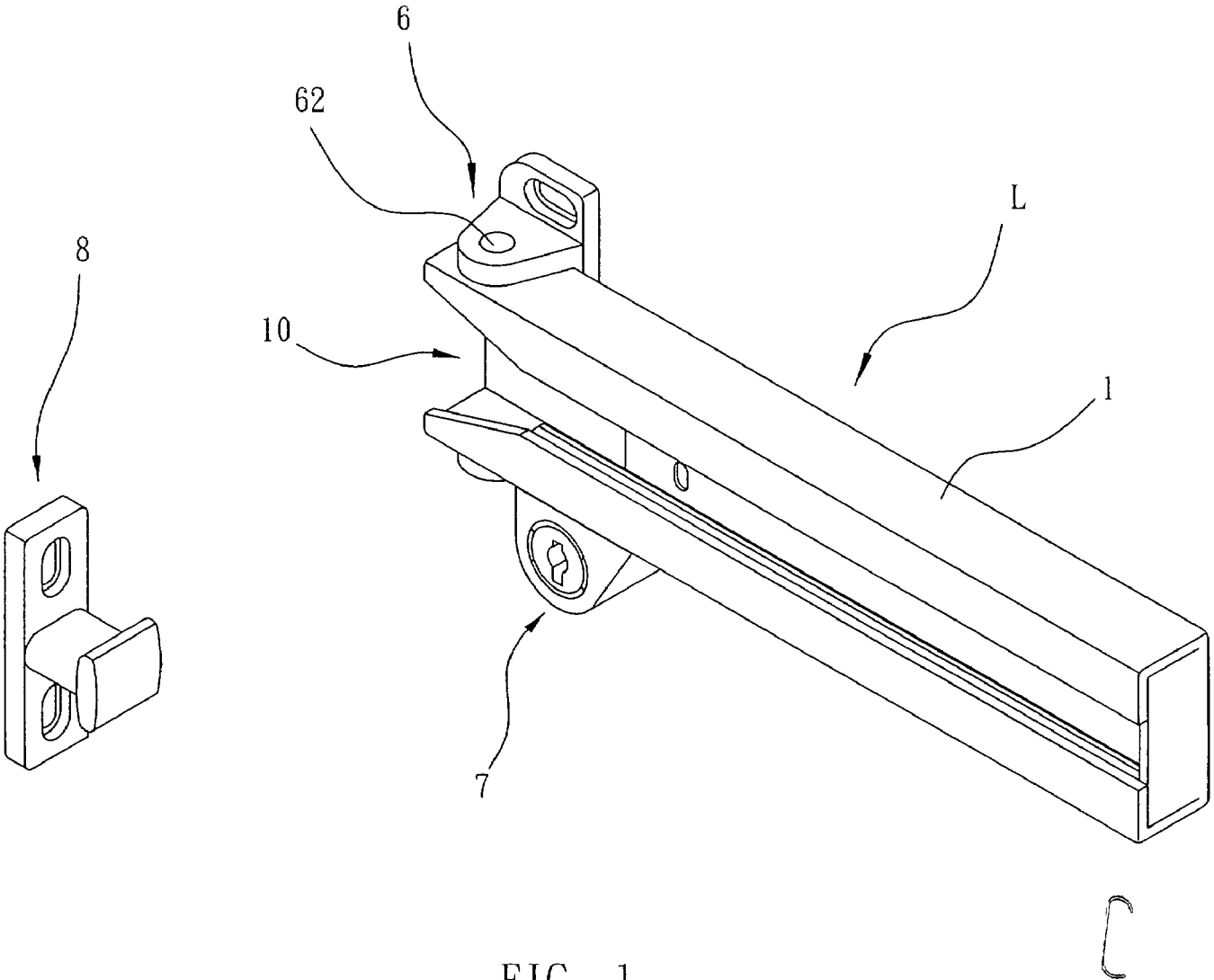
FIG. 1 is an elevational view of a doorplate assembly and a jamb plate for a door bolt according to the present invention.

Referring to FIG. 1, a door bolt in accordance with the present invention is shown comprised of a doorplate assembly L and a jamb plate 8. The doorplate assembly L comprises an elongated casing 1, a mounting plate 6, and a lock cylinder 7. The casing 1 is a hollow rectangular member having an opening 10 in one end there. The top and bottom sidewalls of the opening (open end) 10 of the casing 1 are fastened pivotally with the mounting plate 6 by pivot pins 62 so that the casing 1 can be turned relative to the mounting plate 6. The lock cylinder 7 is provided at the bottom side of the casing 1. The mounting plate 6 and the jamb plate 8 are respectively fixedly fastened to a door panel A and a doorjamb B (see FIG. 7). The jamb plate 8 has a bolt 81 perpendicularly extended from the front side. The bolt 81 has a head 82.

Figure 2:
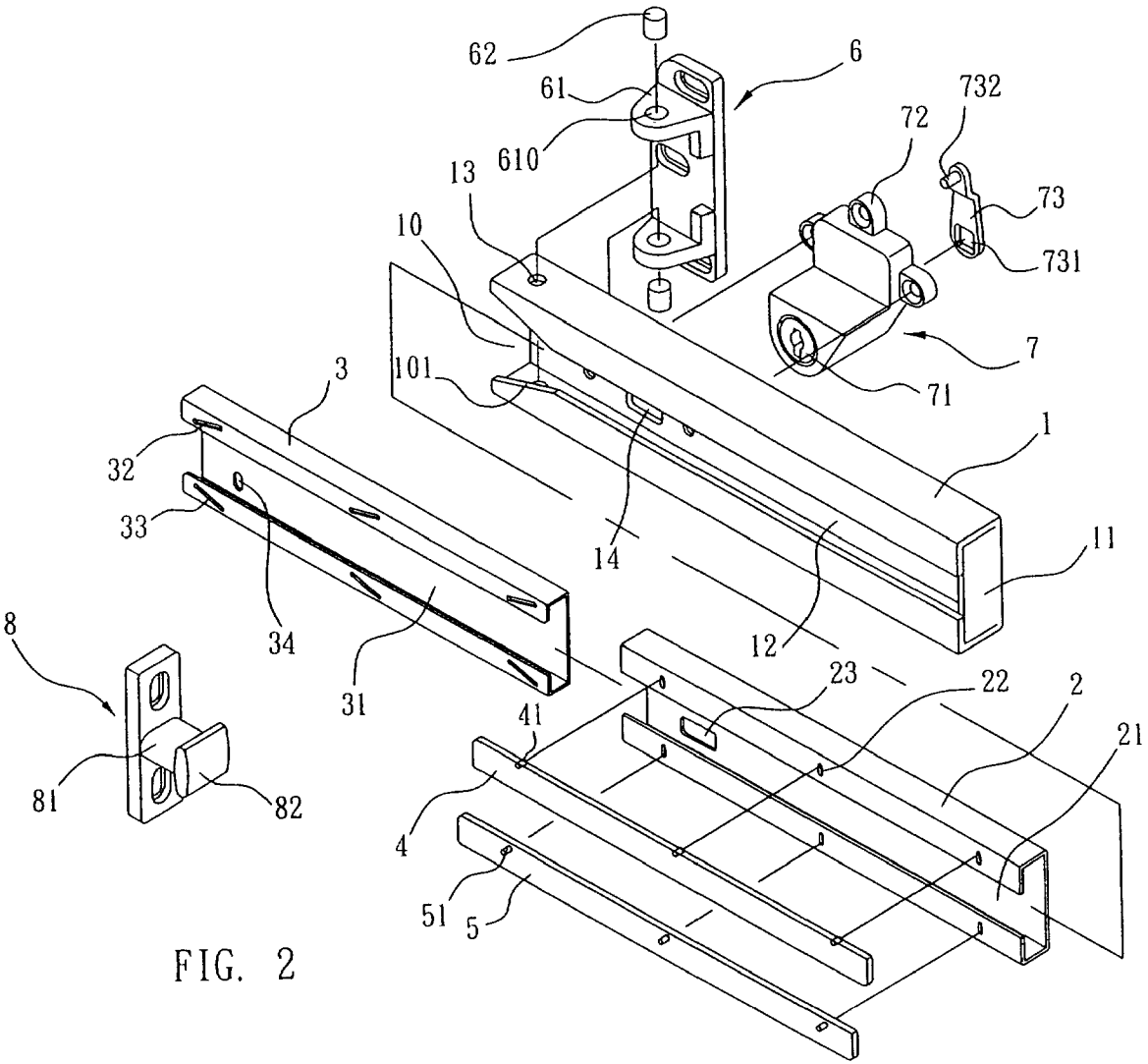
FIG. 2 is an exploded view of the door bolt according to the present invention.
Figure 3:
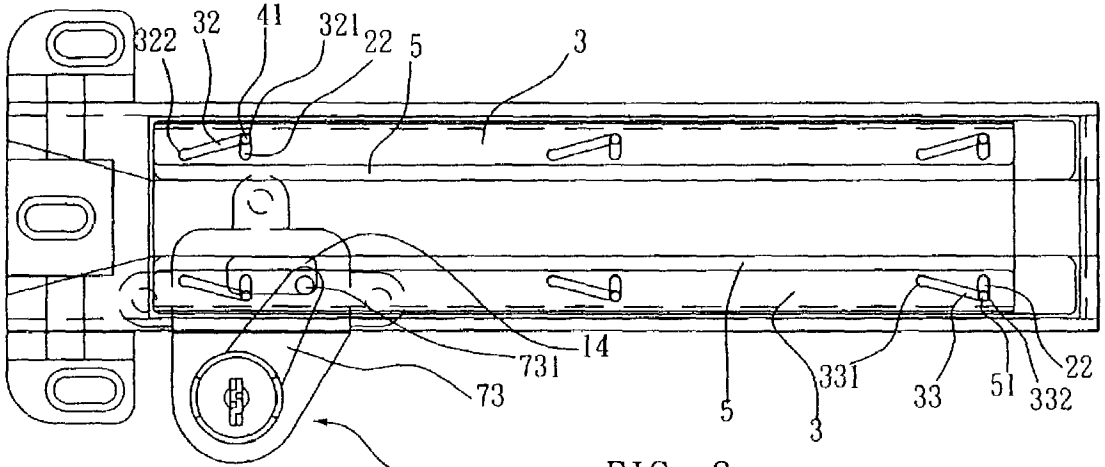
FIG. 3 is a front plain view of the present invention showing the locking straps moved to the unlocking position.

Referring to FIGS. 2 and 3 and FIG. 1 again, the doorplate assembly L is comprised of the aforesaid casing 1, a locating frame bar 2, a movable frame bar 3, a top locking strap 4, a bottom locking strap 5, the aforesaid mounting plate 6, the aforesaid lock cylinder 7, and a link 73. The other end (opposite to the open end 10) of casing 1 is a close end 11. The casing 1 has a sliding slot 12 longitudinally extended from the close end 11 to the open end 10 in the front sidewall, a back hole 14 in the back sidewall, two pivot holes 13 in the top and bottom sidewalls corresponding to the open end 10, and two beveled guide edges 101 formed in the front sidewall corresponding to the open end 10 to expand one end of the sliding slot 12.

The locating frame bar 2 is a hollow rectangular frame bar fitted into the casing 1, having a longitudinal sliding slot 21 extended in the front sidewall between the two distal open ends, a plurality of elongated front holes 22 symmetrically disposed in the front sidewall in vertical direction at two sides of the sliding slot 21, and a back hole 23 in the back sidewall.

The movable frame bar 3 is a hollow rectangular frame bar fitted into the locating frame bar 2, having a longitudinal sliding slot 31 extended in the front sidewall between the two distal open ends, a plurality of first elongated front holes 32 and second elongated front holes 33 symmetrically and obliquely disposed in the front sidewall at different elevations above and below the sliding slot 31, and a back hole 34 in the back sidewall. The first elongated front holes 32 each have a top end portion 321 and a bottom end portion 322 (see FIG. 3). The second elongated front holes 33 each have a top end portion 331 and a bottom end portion 332 (see FIG. 3).

The top locking strap 4 and the bottom locking strap 5 each have a plurality of pegs 41 or 51 perpendicularly protruded from the respective back sidewall corresponding to the elongated front holes 22 of the locating frame bar 2.

Figure 5:
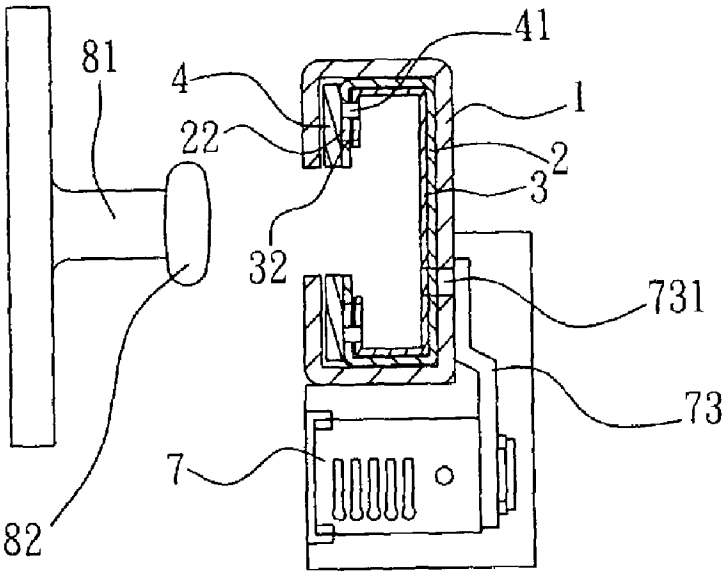
FIG. 5 is a side plain view of the present invention showing the doorplate assembly disconnected from the jamb plate.

The assembly process of the casing 1, the locating frame bar 2, the movable frame bar 3, the top locking strap 4 and the bottom locking strap 5 is outlined hereinafter with reference to FIGS. 2, 3 and 5. The movable frame bar 3 is inserted into the locating frame bar 2, keeping the first and second elongated front holes 32 and 33 respectively aimed at the elongated front holes 22 of the locating frame bar 2, and then the top locking strap 4 is attached to the front sidewall of the locating frame bar 2 to force the pegs 41 into the respective elongated front holes 22 above the sliding slot 21 of the locating frame bar 2 and the first elongated front holes 32 of the movable frame bar 3, and then the bottom locking strap 5 is attached to the front sidewall of the locating frame bar 2 to force the pegs 51 into the respective elongated front holes 22 below the sliding slot 21 of the locating frame bar 2 and the second elongated front holes 33 of the movable frame bar 3, and then the top and bottom locking straps 4 and 5 are inserted with the locating frame bar 2 and the movable frame bar 3 through the open end 10 into the inside of the casing 1, keeping the back hole 14 of the casing 1 aimed at the back hole 23 of the locating frame bar 2 and the back hole 34 of the movable frame bar 3.

Referring to FIGS. 1 and 2 again, the mounting plate 6 has two parallel lugs 61 perpendicularly extended from the front sidewall and spaced from each other at a distance approximately equal to the vertical width of the casing 1. The lugs 61 each have a pin hole 610. The aforesaid pivot pins 62 are respectively mounted in the pin holes 610 of the lugs 61 of the mounting plate 6 and respectively inserted into the pivot holes 13 in the top and bottom sidewall of the casing 1 to pivotally secure the open end 10 of the casing 1 to the mounting plate 6. The lock cylinder 7 has a plurality of mounting lugs 72 respectively fixedly fastened to the back sidewall of the casing 1 by screws. The link 73 has a coupling hole 731 formed in one end and coupled to the spindle (not shown) of the lock cylinder 7, and a coupling rod 732 extended from the other end and inserted through the back hole 14 of the casing 1 and the back hole 23 of the locating frame bar 2 and fitted into the back hole 34 of the movable frame bar 3. The back hole 14 of the casing 1 and the back hole 23 of the locating frame bar 2 are longitudinal sliding holes. When the user inserted the key (not shown) into the keyway 71 of the lock cylinder 7 and rotated, the link 73 is driven by the spindle of the lock cylinder 7 to move the movable frame bar 3 in the locating frame bar 2.

Figure 4:
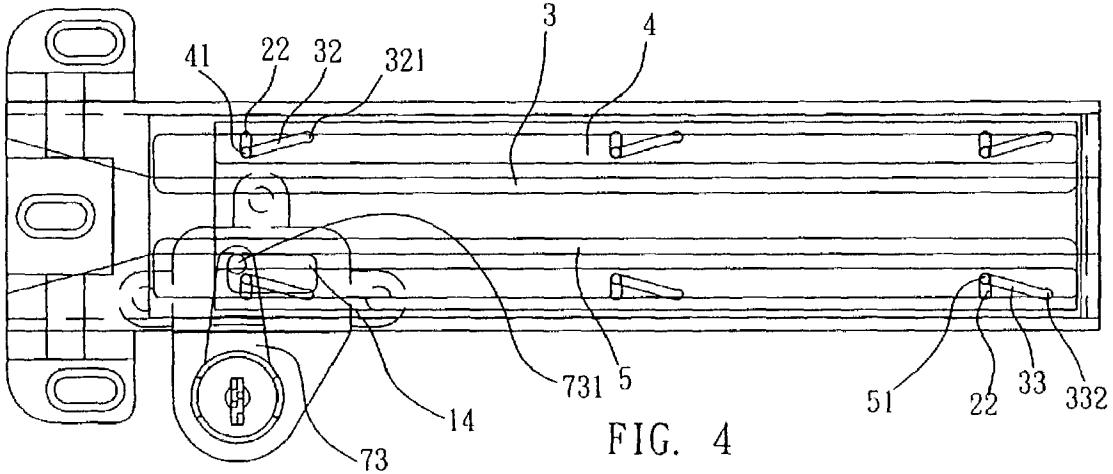
FIG. 4 is similar to FIG. 3 but showing the locking straps moved to the locking position.
Figure 6:
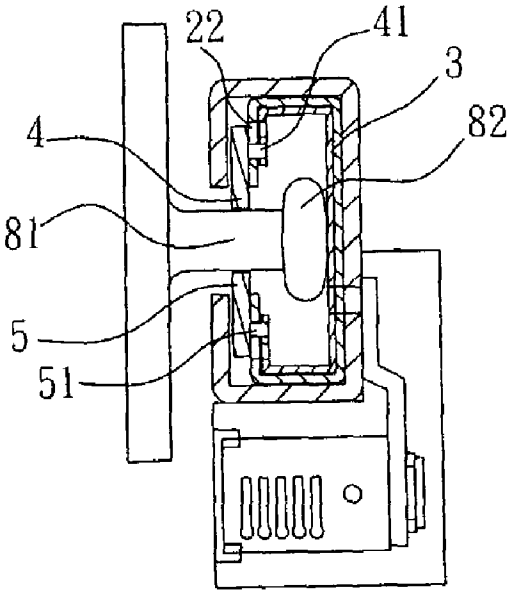
FIG. 6 is another side plain view of the present invention, showing the doorplate assembly coupled to the jamb plate, the locking straps moved to the locking position.

Referring to FIGS. 4 and 6, when the movable frame bar 73 moved rightwards in the locating frame bar 2, the first and second elongated front holes 32 and 33 of the movable frame bar 3 guide the pegs 41 and 51 of the top and bottom locking straps 4 and 5 to move to the bottom end portions 322 of the first elongated front holes 32 and the top end portions 331 of the second elongated front holes 33 respectively, and therefore the top locking strap 4 and the bottom locking strap 5 are moved in direction toward each other to narrow the vertical width of the sliding slot 12 of the casing 2. At this time, the bolt 81 of the jamb plate 8 can be inserted through the open end 10 into the inside of the casing 1 and moved along the sliding slot 12. Because the vertical width of the sliding slot 21 is narrowed by the top and bottom locking straps 4 and 5, the top and bottom locking straps 4 and 5 stop the head 82 of the bolt 81 inside the casing 1, and the bolt 81 is prohibited from transverse movement across the sliding slot 12.

Referring to FIGS. 3 and 5 again, when wishing to disconnect the jamb plate 8 from the casing 1, insert the key into the keyway 71 of the lock cylinder 7 and then rotate the key in the reversed direction to move the movable frame bar 3 leftwards. At this time, the first and second elongated front holes 32 and 33 of the movable frame bar 3 guide the pegs 41 and 51 of the top and bottom locking straps 4 and 5 to move to the top end portions 321 of the first elongated front holes 32 and the bottom end portions 332 of the second elongated front holes 33 respectively, and therefore the top locking strap 4 and the bottom locking strap 5 are moved in direction apart from each other to fully open the sliding slot 12 of the casing 2, for enabling the head 82 to be moved with bolt 81 of the jamb plate 8 across the sliding slot 12 to the outside of the casing 1.

Figure 7:
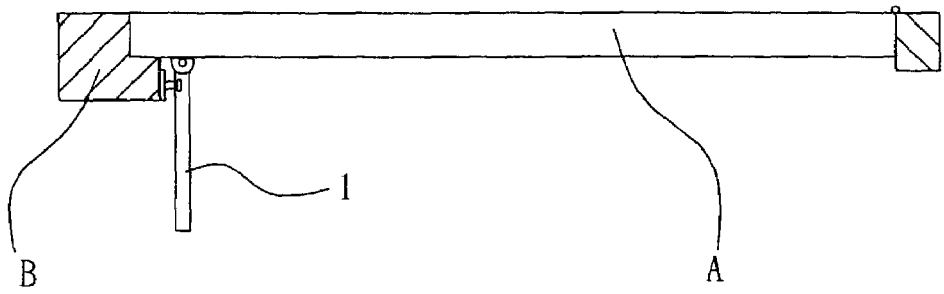
FIG. 7 is a schematic drawing, showing the doorplate assembly and the jamb plate respectively installed in the door panel and the doorjamb, the doorplate assembly secured to the jamb plate, the door panel closed.
Figure 8:
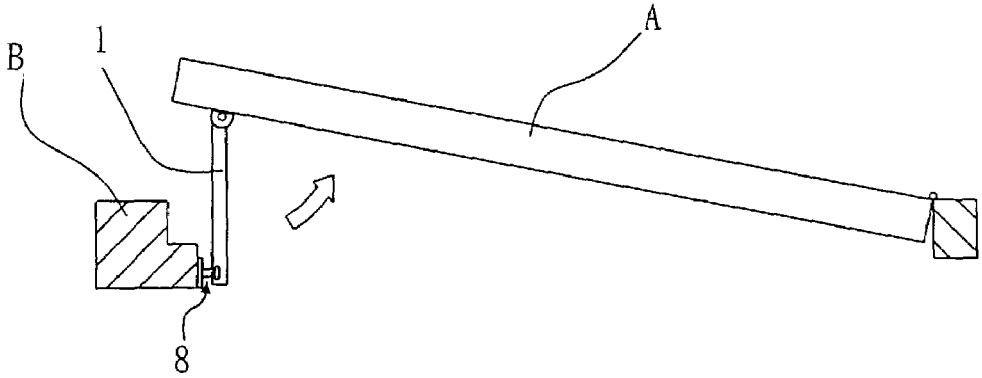
FIG. 8 is a schematic drawing, showing the doorplate assembly secured to the jamb plate and the door panel slightly opened.
Figure 9:
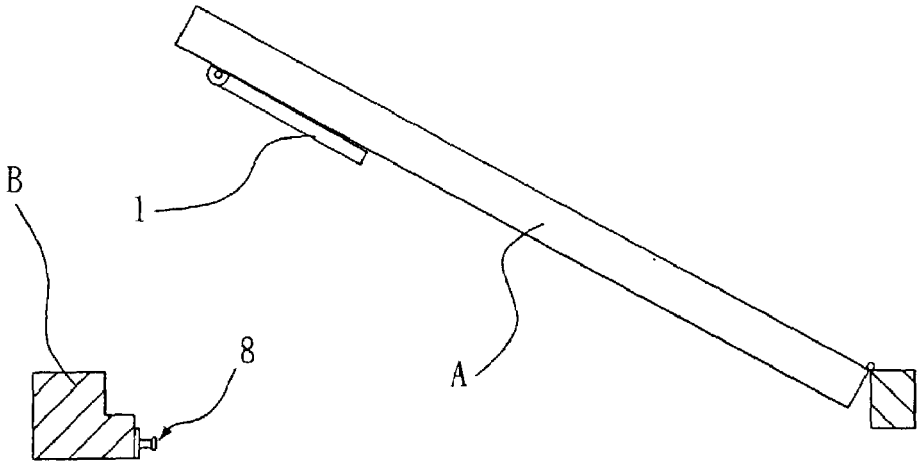
FIG. 9 is a schematic drawing showing the doorplate assembly disconnected from the jamb plate, the door panel opened.

Referring to FIGS. 7~9, the doorplate assembly L and the jamb plate 8 are respectively fastened to the door panel A and the doorjamb B. When the door panel A closed, the doorplate assembly L is coupled to the jamb plate 8. When opening the door panel A after the doorplate assembly L has been coupled to the jamb plate 8, the jamb plate 8 constrains the doorplate assembly L, prohibiting the door panel A from being opened (see FIG. 8). A person outside the door can use the key to unlock the lock cylinder of the door plate assembly L and to release the door plate assembly L from the constraint of the jamb plate 8, enabling the door panel A to be opened (see FIG. 9).

A prototype of door bolt has been constructed with the features of the annexed drawings of FIGS. 1~9. The door bolt functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A door bolt comprising a jamb plate fixedly fastened to a doorjamb, and a doorplate assembly installed in the free end of a door panel and adapted to secure the free end of said door panel to said jamb plate, wherein:

said jamb plate comprises a bolt perpendicularly extended from a front sidewall thereof for securing said doorplate assembly, said bolt having an expanded head;

said doorplate assembly comprises:

a mounting plate fixedly fastened to said door panel, a rectangular casing, said rectangular casing having an open end fastened pivotally with said mounting plate, a closed end, and a longitudinal sliding slot longitudinally extended in a front sidewall thereof from said closed end to said open end, the longitudinal sliding slot of said casing having a vertical width greater than the diameter of the head of said bolt of said jamb plate;

a fixed hollow rectangular locating frame bar provided inside said casing, said locating frame bar having one open end, a longitudinal sliding slot formed in a front sidewall thereof and longitudinally extended from the open end, a plurality of elongated front holes symmetrically disposed in the front sidewall in vertical direction at two sides of the longitudinal sliding slot of said locating frame bar;

a hollow rectangular movable frame bar axially slidably inserted into the inside of said locating frame bar, said movable frame bar having one open end corresponding to the open end of said locating frame bar and the open end of said casing, a longitudinal sliding slot extended in a front sidewall thereof and matching the longitudinal sliding slot of said locating frame bar, and a plurality of first elongated front holes and second elongated front holes symmetrically and obliquely disposed in a front sidewall thereof at different elevations above and below the sliding slot of said movable frame bar;

a top locking strap and a bottom locking strap respectively coupled to said movable frame bar and said locating frame bar at different elevations and disposed between the front sidewall of said locating frame bar and the front sidewall of said casing and adapted to be moved by said movable frame bar to narrow the vertical width of the longitudinal sliding slot of said casing, said top locking strap and said bottom locking strap having a plurality of pegs respectively inserted into the vertically extended elongated front holes of said locating frame bar and the obliquely extended elongated front holes of said movable frame bar; and a lock cylinder fixedly located on said casing, said lock cylinder having a link coupled to said movable frame bar and controlled by a key to move said movable frame bar relative to said locating frame bar and to further move said top locking strap and said bottom locking strap in vertical direction relative to each other between a first position where the longitudinal sliding slot of said casing is fully opened for enabling said doorplate assembly to be coupled to the bolt of said jamb plate and a second position where said top locking strap and said bottom locking strap narrow the vertical width of the longitudinal sliding slot of said casing to stop the head of the bolt of said jamb plate inside said casing.

2. The door bolt as claimed in claim 1 wherein said casing has an elongated sliding back hole in a back sidewall thereof; said locating frame bar has an elongated sliding back hole in a back sidewall thereof corresponding to the elongated sliding back hole of said casing; said link having a pin extended from one end thereof remote from said lock cylinder and inserted through the elongated sliding back hole of said casing and the elongated sliding back hole of said locating frame bar and pivoted to said movable frame bar.

3. The door bolt as claimed in claim 1 wherein said mounting plate has two parallel eyed lugs disposed at different elevations; said casing has two pivot holes respectively formed in top and bottom sidewalls thereof in the open end of said casing and respectively pivoted to the eyed lugs of said mounting plate by a respective pivot.

* * * * *